US009905906B2

(12) United States Patent
Yang et al.

(10) Patent No.: US 9,905,906 B2
(45) Date of Patent: Feb. 27, 2018

(54) SATELLITE ANTENNA

(71) Applicant: Wistron NeWeb Corp., Hsinchu (TW)

(72) Inventors: Lan-Chun Yang, Hsinchu (TW); Shun-Chung Kuo, Hsinchu (TW); San-Yi Kuo, Hsinchu (TW)

(73) Assignee: Wistron Neweb Corp., Hsinchu (TW)

( * ) Notice: Subject to any disclaimer, the term of this patent is extended or adjusted under 35 U.S.C. 154(b) by 194 days.

(21) Appl. No.: 14/921,139

(22) Filed: Oct. 23, 2015

(65) Prior Publication Data

US 2016/0218413 A1 Jul. 28, 2016

(30) Foreign Application Priority Data

Jan. 28, 2015 (TW) ..... 104102802 A

(51) Int. Cl.
*H01Q 1/12* (2006.01)
*H01Q 19/13* (2006.01)

(52) U.S. Cl.
CPC ..... *H01Q 1/1235* (2013.01); *H01Q 1/1228* (2013.01); *H01Q 19/132* (2013.01)

(58) Field of Classification Search
CPC ..... H01Q 1/12; H01Q 19/13
See application file for complete search history.

(56) References Cited

U.S. PATENT DOCUMENTS 358,306 A * 2/1887 Tiebout ..... B63B 21/44 114/303
5,005,390 A * 4/1991 Giannini ..... B60R 9/10 70/202
2008/0062056 A1* 3/2008 Hoferer ..... H01P 1/161 343/776

* cited by examiner

*Primary Examiner* — Andrea Lindgren Baltzell
(74) *Attorney, Agent, or Firm* — Muncy, Geissler, Olds & Lowe, P.C.

(57) ABSTRACT

A satellite antenna is provided. The satellite antenna includes a first member, a second member and a connecting unit. A first opening is formed on the first member. A second opening is formed on the second member. The connecting unit fixes the first member to the second member. The connecting unit includes a connection post, an abutting element and a rotatable stopper. The connection post includes a first end and a second end. The abutting element pivots on the first end of the connection post. The rotatable stopper pivots on the second end of the connection post, wherein in a fixing state, the connection post passes through the first opening and the second opening, the abutting element pulls the rotatable stopper to tightly abut a first surface of the first member, and the first member is fixed to the second member.

11 Claims, 7 Drawing Sheets

SATELLITE ANTENNA

CROSS REFERENCE TO RELATED APPLICATIONS

This Application claims priority of Taiwan Patent Application No. 104102802, filed on Jan. 28, 2015, the entirety of which is incorporated by reference herein.

BACKGROUND OF THE INVENTION

Field of the Invention

The present invention relates to a satellite antenna, and in particular to a satellite antenna can be easily assembled and disassembled.

Description of the Related Art

In the conventional satellite antenna, different members (for example, the connection rod and the receiver) are connected and fixed by bolts and nuts. Additional manual tools are required to fix the bolts and nuts during the assembly process. The assembly process requires time and effort. Additionally, the threads of the bolts are easily damaged, and the assembly process can therefore be interrupted.

BRIEF SUMMARY OF THE INVENTION

In one embodiment, a satellite antenna is provided. The satellite antenna includes a first member, a second member and a connecting unit. A first opening is formed on the first member. A second opening is formed on the second member. The connecting unit fixes the first member to the second member. The connecting unit includes a connection post, an abutting element and a rotatable stopper. The connection post includes a first end and a second end. The abutting element pivots on the first end of the connection post. The rotatable stopper pivots on the second end of the connection post, wherein in a fixing state, the connection post passes through the first opening and the second opening, the abutting element pulls the rotatable stopper to tightly abut a first surface of the first member, and the first member is fixed to the second member.

In one embodiment, the abutting element pivots between an abutting orientation and a releasing orientation, the abutting element comprises a cam portion and a wrench portion, an extending direction of the cam portion is perpendicular to an extending direction of the wrench portion, and when the wrench portion is pushed to move the abutting element to the abutting orientation, the cam portion abuts a second surface of the first member, and the first surface is opposite the second surface.

In one embodiment, the rotatable stopper pivots between a first orientation and a second orientation, and when the rotatable stopper is in the first orientation, the rotatable stopper is adapted to pass through the first opening and the second opening, and when the rotatable stopper is in the second orientation, the rotatable stopper abuts the first surface of the first member.

In one embodiment, the first opening and the second opening are circular holes, the rotatable stopper is a longitudinal structure, the second end of the connection post pivots on a center portion of the rotatable stopper, and in an assembled state, the rotatable stopper and the connection post is located on the same straight line, and the rotatable stopper passes through the first opening and the second opening.

In one embodiment, in the fixing state, the rotatable stopper and the connection post form a T-shaped structure.

In one embodiment, the satellite antenna further comprises a satellite dish and a supporting frame, wherein the first member is a connection rod, the second member is a receiver, the second member is corresponding to the satellite dish, the supporting frame is connected to the satellite dish, and the first member is connected to the supporting frame and the second member.

In one embodiment, the rotatable stopper comprises a circular plate and a pivot portion, the pivot portion is disposed on the circular plate, and the second end of the connection post is connected to the pivot portion.

In one embodiment, the second opening comprises a slot area and an opening area, the slot area is connected to the opening area, in an assembled state, the circular plate is parallel to the connection post, and the circular plate passes through the slot area.

In one embodiment, in the fixing state, the pivot portion is located in the opening area, and the circular plate is perpendicular to the connection post.

In one embodiment, the satellite antenna further comprises a receiver and a connection rod, wherein the first member is a satellite dish, the second member is a supporting frame, the receiver is corresponding to the first surface of the first member, the second member is connected to the satellite dish, and the connection rod is connected to the second member and the receiver.

In one embodiment, the first opening is formed in a circular recess, and the circular recess is formed on the first surface.

In one embodiment, the abutting element pivots between an abutting orientation and a releasing orientation, the abutting element comprises a cam portion and a wrench portion, an extending direction of the cam portion is perpendicular to an extending direction of the wrench portion, and in the fixing state, the abutting element is in the abutting orientation, the cam portion abuts a third surface of the second member, and the first surface is opposite the third surface.

Utilizing the embodiments of the invention, the first member and the second member of the satellite antenna can be easily assembled or disassembled without any manual tools. Additionally, the number of bolts of the satellite antenna is decreased, and the problem of bolt thread damage is reduced.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1A:
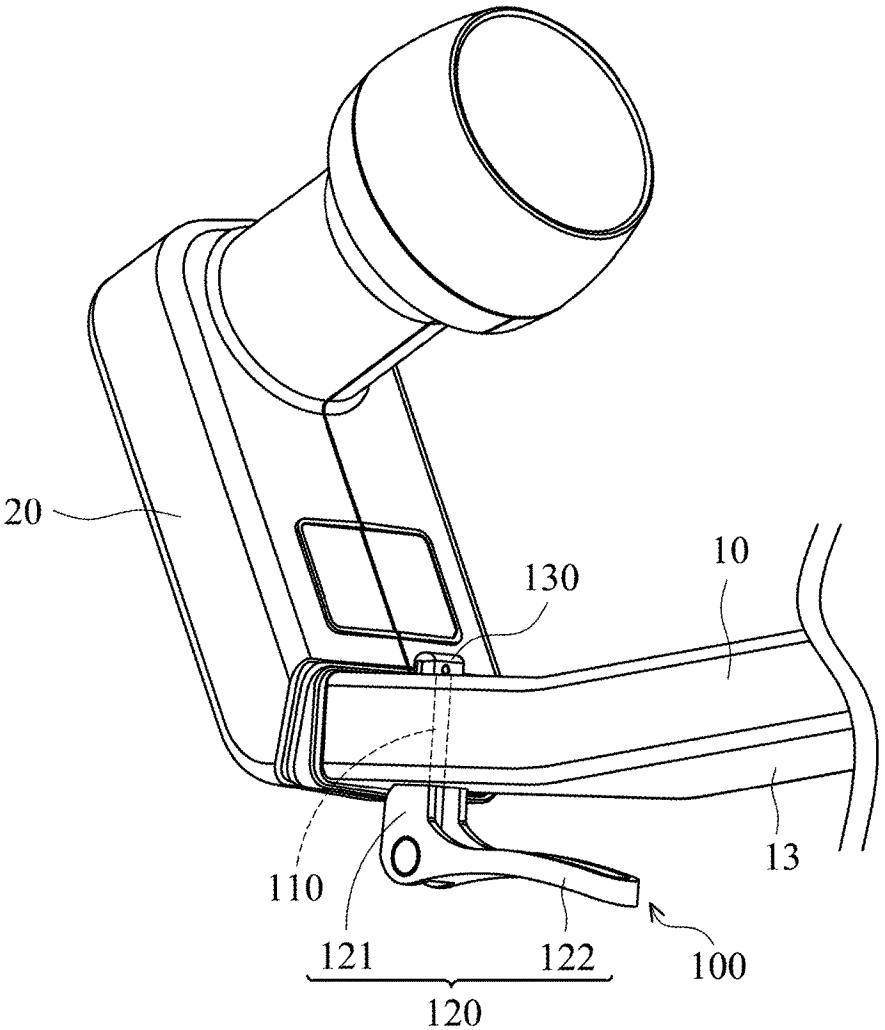
FIG. 1A shows a satellite antenna of a first embodiment of the invention, wherein the satellite antenna is in a fixing state.
Figure 1B:
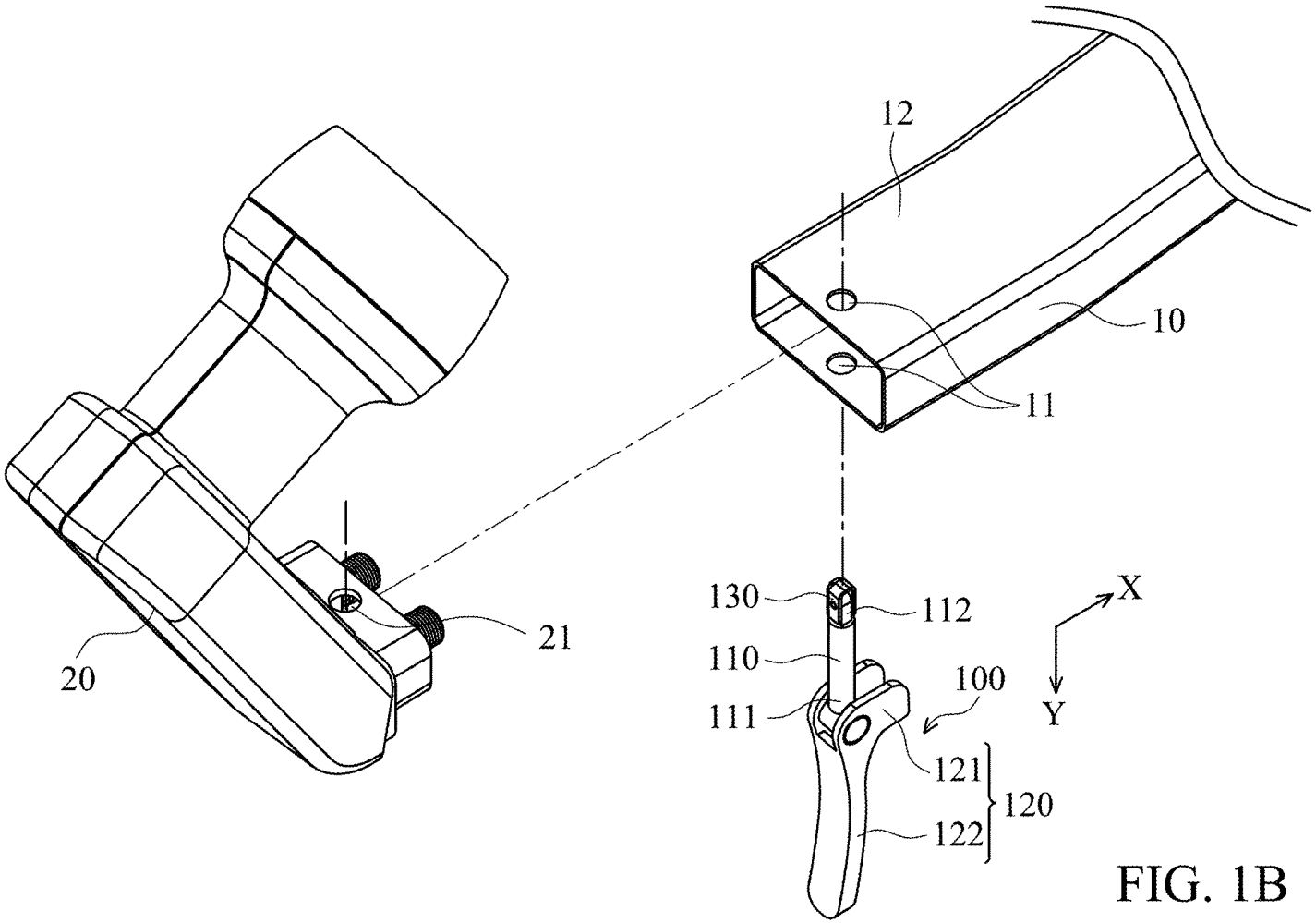
FIG. 1B shows the satellite antenna of the first embodiment of the invention, wherein the satellite antenna is in an assembly state.

FIGS. 1A and 1B show a satellite antenna of a first embodiment of the invention, including a connection rod (first member of the first embodiment) 10, a receiver (second member of the first embodiment) 20 and a connecting unit 100. First openings 11 are formed on the connection rod 10. Second openings 21 are formed on the receiver 20. The connecting unit 100 fixes the connection rod 10 to the receiver 20. The connecting unit 100 comprises a connection post 110, an abutting element 120 and a rotatable stopper 130. The connection post 110 comprises a first end 111 and a second end 112. The abutting element 120 pivots on the first end 111 of the connection post 110. The rotatable stopper 130 pivots on the second end 112 of the connection post 110. In a fixing state (FIG. 1A), the connection post 110 passes through the first openings 11 and the second openings 21. The abutting element 120 pulls the rotatable stopper 130 to tightly abut a first surface 12 of the connection rod 10, and the connection rod 10 is fixed to the receiver 20. In the embodiment above, the rotatable stopper 130 is manually rotated by the user to abut the first surface 12.

With reference to FIGS. 1A and 1B, the abutting element 120 pivots between an abutting orientation (FIG. 1A) and a releasing orientation (FIG. 1B), the abutting element 120 comprises a cam portion 121 and a wrench portion 122. With reference to FIG. 1B, the extending direction X of the cam portion 121 is perpendicular to the extending direction Y of the wrench portion 122. With reference to FIG. 1A, in the fixing state, the abutting element 120 is in the abutting orientation, and the cam portion 121 abuts a second surface 13 of the connection rod 10. The first surface 12 is opposite the second surface 13. The cam portion 121 pushes the second surface 12 of the connection rod 10 to reduce a free space on the connection post 110 between the abutting element 120 and the rotatable stopper 130. The rotatable stopper 130 therefore tightly abuts the first surface 12 of the connection rod 10. The abutting element 120 pivots on the connection post 110 by bolts or other elements.

With reference to FIGS. 1A and 1B, the rotatable stopper 130 pivots between a first orientation (FIG. 1B) and a second orientation (FIG. 1A). When the rotatable stopper 130 is in the first orientation (FIG. 1B), the rotatable stopper 130 is adapted to pass through the first openings 11 and the second openings 21. When the rotatable stopper 130 is in the second orientation (FIG. 1A), the rotatable stopper 130 abuts the first surface 12 of the connection rod 10. In this embodiment, the first openings 11 and the second openings 21 are circular holes and the rotatable stopper 130 is a longitudinal structure. The second end 112 of the connection post 110 pivots on a center portion of the rotatable stopper 130. In an assembly state (FIG. 1B), the rotatable stopper 130 and the connection post 110 are located on the same straight line, and the rotatable stopper 130 passes through the first openings 11 and the second openings 21. In the fixing state (FIG. 1A), the rotatable stopper 130 and the connection post 110 form a T-shaped structure.

In the embodiment above, the rotatable stopper 130 can be a stamping part with a U-shaped cross section. The rotatable stopper 130 provides reliable fixing function with decreased dimension. Utilizing the first embodiment of the invention, the first member and the second member of the satellite antenna can be easily assembled or disassembled without any manual tools.

Figure 2A:
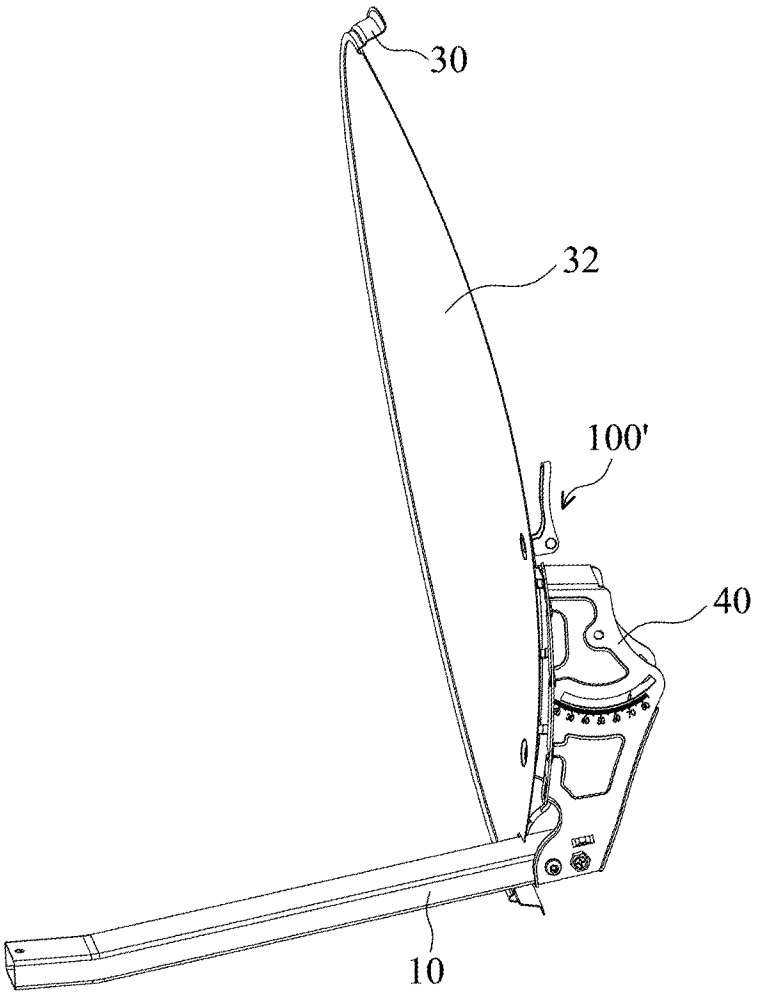
FIG. 2A shows a satellite antenna of a second embodiment of the invention, wherein the satellite antenna is in a fixing state.
Figure 2B:
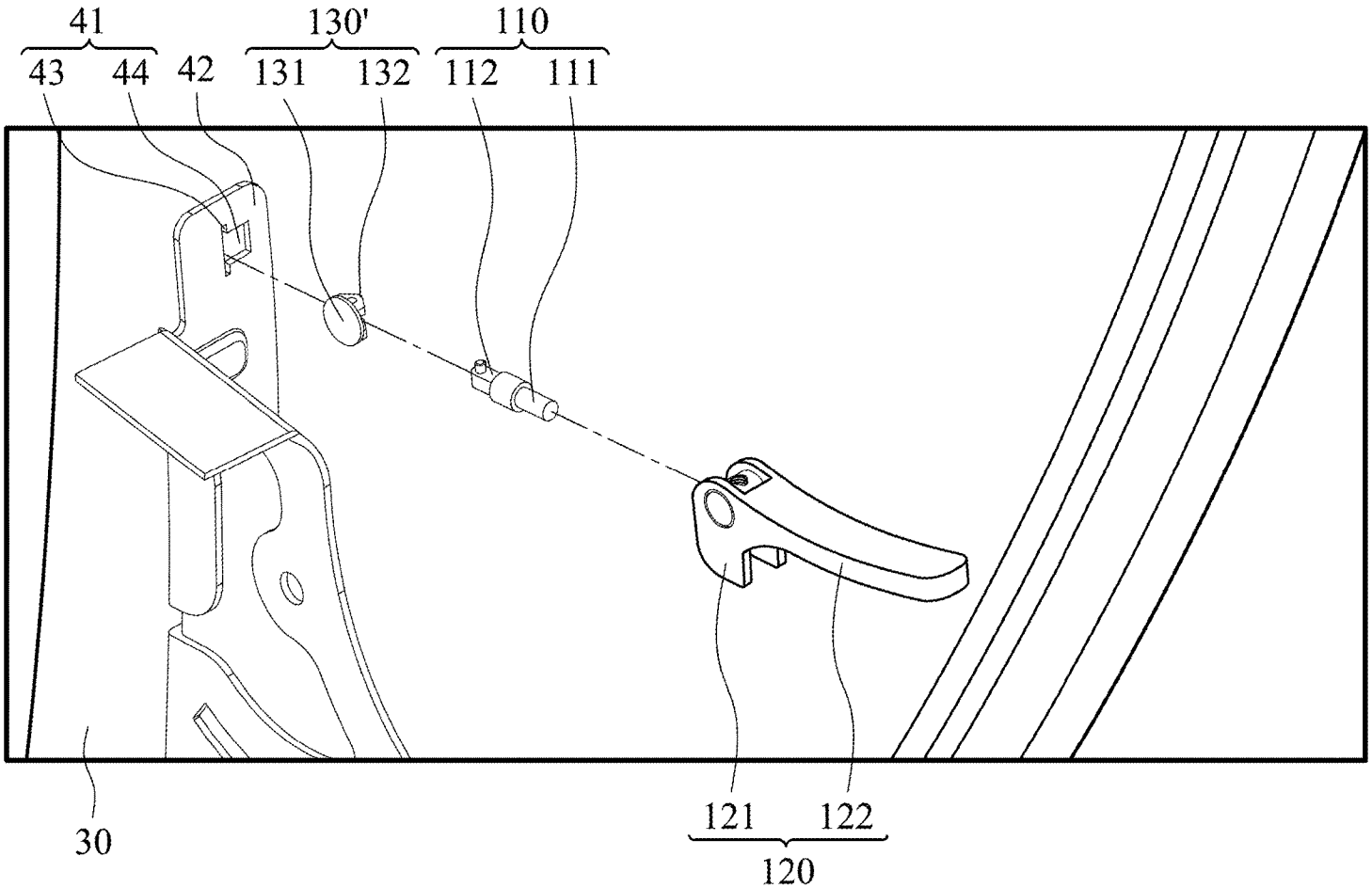
FIG. 2B shows the satellite antenna of the second embodiment of the invention, wherein the satellite antenna is in an assembly state.
Figure 3B:
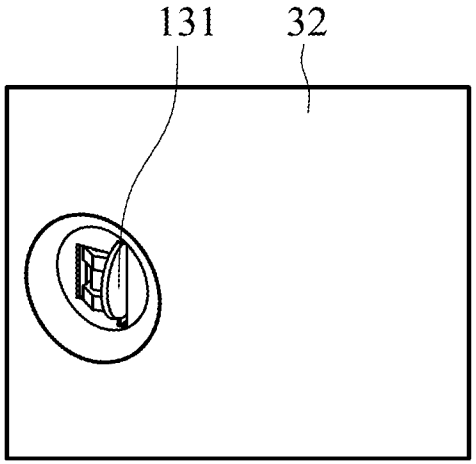
FIG. 3A-3D shows an assembly process of the satellite antenna of the second embodiment of the invention.
Figure 3A:
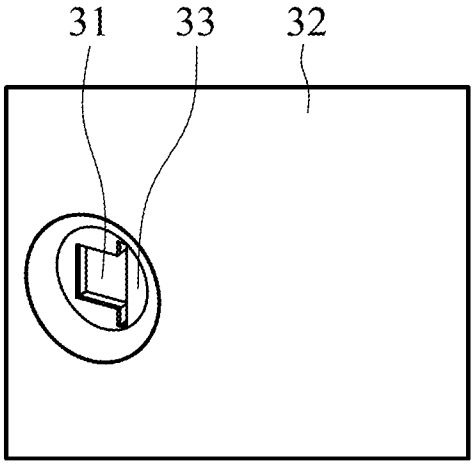

FIGS. 2A and 2B show a satellite antenna of a second embodiment of the invention, including a satellite dish (first member of the second embodiment) 30, a supporting frame (second member of the second embodiment) 40 and the connecting unit 100'. A first opening 31 is formed on the satellite dish 30 (with reference to FIG. 3A). A second opening 41 is formed on the supporting frame 40. The connecting unit 100' fixes the satellite dish 30 to the supporting frame 40. The connecting unit 100' comprises a connection post 110, an abutting element 120 and a rotatable stopper 130'. The connection post 110 comprises a first end 111 and a second end 112. The abutting element 120 pivots on the first end 111 of the connection post 110. The rotatable stopper 130' pivots on the second end 112 of the connection post 110. In a fixing state (FIG. 2A), the connection post 110 passes through the first opening 31 and the second opening 41. The abutting element 120 pulls the rotatable stopper 130' to tightly abut a first surface 32 of the satellite dish 30. In the fixing state (FIG. 2A), the cam portion 121 of the abutting element 120 abuts a third surface 42 of the supporting frame 40, and the first surface 32 is opposite the third surface 42.

Figure 2C:
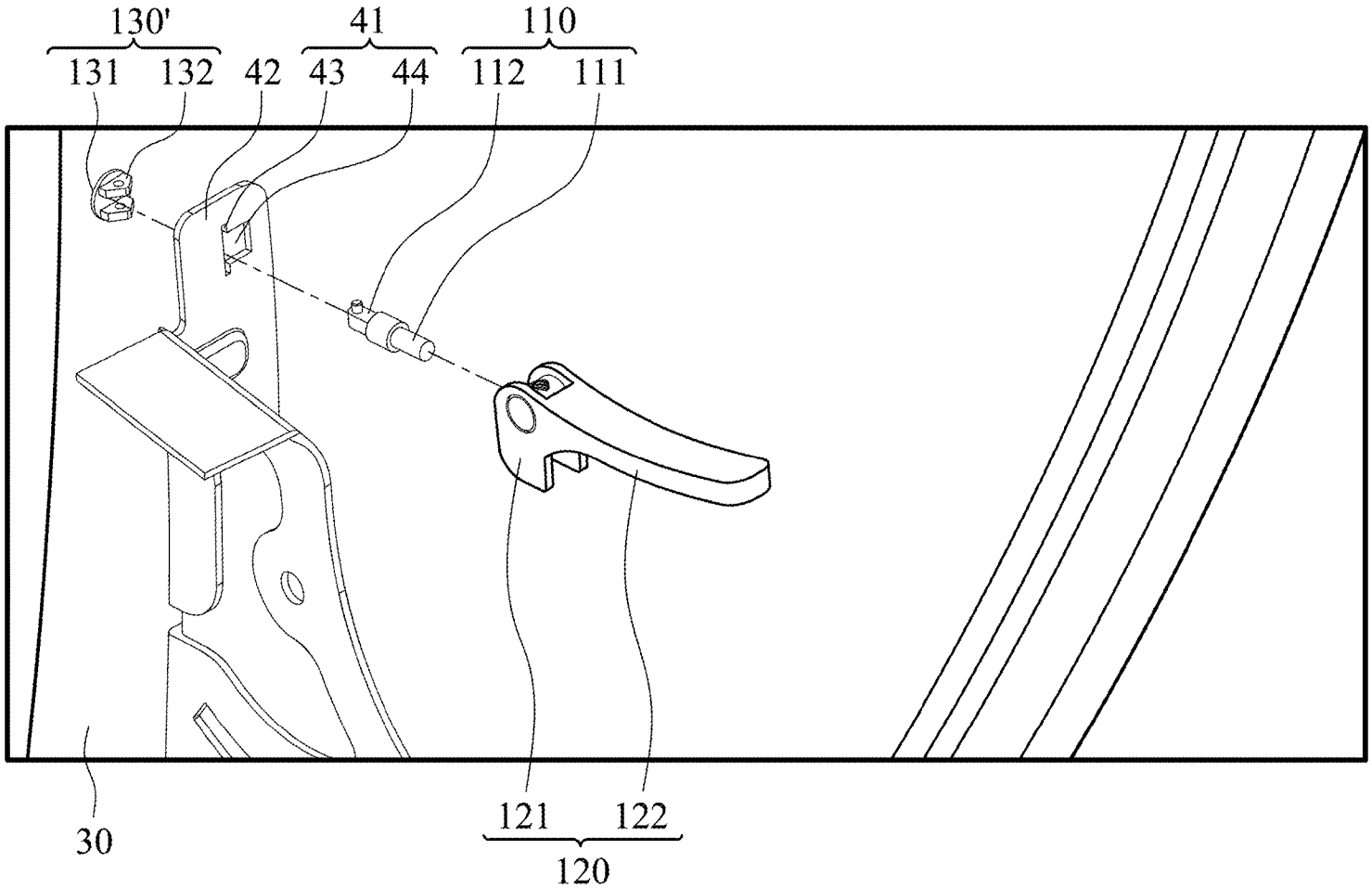
FIG. 2C shows detailed structure of a rotatable stopper of the second embodiment of the invention.

With reference to FIG. 2C, in the second embodiment, the rotatable stopper 130' comprises a circular plate 131 and a pivot portion 132. The pivot portion 132 is disposed on the circular plate 131, and the second end 112 of the connection post 110 is connected to the pivot portion 132. In this embodiment, the second opening 41 comprises a slot area 43 and an opening area 44, and the slot area 43 is connected to the opening area 44. In an assembly state (FIG. 2B), the circular plate 131 is parallel to the connection post 110, the circular plate 131 passes through the slot area 43, and the pivot portion 132 passes through the opening area 44.

With reference to FIG. 2C, in the fixing state, the pivot portion 132 is located in the opening area 44, and the circular plate 131 is perpendicular to the connection post 110.

Figure 3D:
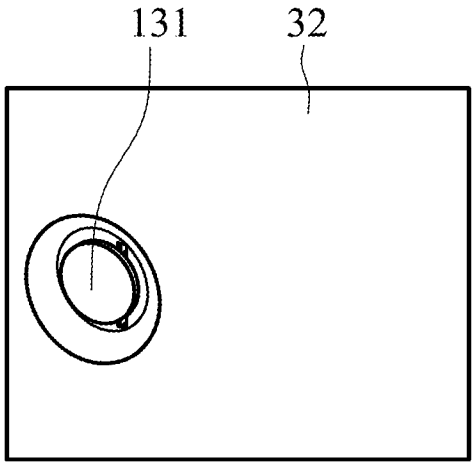
Figure 3C:
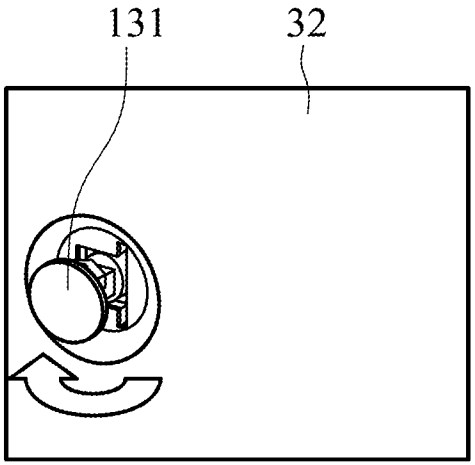

With reference to FIGS. 3A-3D, in one embodiment, the first opening 31 is formed in a circular recess 33, and the circular recess 33 is formed on the first surface 32 (in this embodiment, the first surface 32 is the reflective surface of the satellite dish). In the assembly process, the circular plate 131 passes through the first opening 31 (FIG. 3B) first. Then, the circular plate 131 is rotated to be perpendicular to the connection post 110 (FIG. 3C). Finally, the abutting element 120 is twisted into the fixing state (FIG. 3D). In the fixing state, the circular plate 131 is located in the circular recess 33 to cover the first opening 31 to improve the appearance and integrity of the satellite antenna, which maintains the reflective effect of the satellite dish. In one embodiment, the circular plate 131 can sufficiently cover the circular recess 33.

Utilizing the second embodiment of the invention, the first member and the second member of the satellite antenna can be easily assembled or disassembled without any manual tools. Additionally, the appearance of the satellite antenna and the reflective effect of the satellite dish are improved. Utilizing the embodiments of the invention, the number of bolts of the satellite antenna is decreased, and the problem of the bolt thread damage is reduced.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term).

While the invention has been described by way of example and in terms of the preferred embodiments, it is to be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A satellite antenna, comprising:

a first member, with a first opening formed on the first member;

a second member, with a second opening formed on the second member; and a connecting unit, fixing the first member to the second member, including:

a connection post, comprising a first end and a second end;

an abutting element, pivoted on the first end of the connection post; and a rotatable stopper, pivoted on the second end of the connection post, wherein in a fixing state, the connection post passes through the first opening and the second opening, the abutting element pulls the rotatable stopper to tightly abut a first surface of the first member, and the first member is fixed to the second member, wherein the rotatable stopper pivots between a first orientation and a second orientation, wherein when the rotatable stopper is in the first orientation, the rotatable stopper is adapted to pass through the first opening and the second opening, and when the rotatable stopper is in the second orientation, the rotatable stopper abuts the first surface of the first member.

2. The satellite antenna as claimed in claim 1, wherein the abutting element pivots between an abutting orientation and a releasing orientation, the abutting element comprises a cam portion and a wrench portion, and an extending direction of the cam portion is perpendicular to an extending direction of the wrench portion, wherein in the fixing state, the abutting element is in the abutting orientation, the cam portion abuts a second surface of the first member, and the first surface is opposite the second surface.

3. The satellite antenna as claimed in claim 1, wherein the first opening and the second opening are circular holes, the rotatable stopper is a longitudinal structure, the second end of the connection post pivots on a center portion of the rotatable stopper, and in an assembled state, the rotatable stopper and the connection post is located on the same straight line, and the rotatable stopper passes through the first opening and the second opening.

4. The satellite antenna as claimed in claim 3, wherein in the fixing state, the rotatable stopper and the connection post form a T-shaped structure.

5. The satellite antenna as claimed in claim 3, further comprising a satellite dish and a supporting frame, wherein the first member is a connection rod, the second member is a receiver, the second member is corresponding to the satellite dish, the supporting frame is connected to the satellite dish, and the first member is connected to the supporting frame and the second member.

6. The satellite antenna as claimed in claim 1, wherein the rotatable stopper comprises a circular plate and a pivot portion, the pivot portion is disposed on the circular plate, and the second end of the connection post is connected to the pivot portion.

7. The satellite antenna as claimed in claim 6, wherein the second opening comprises a slot area and an opening area, the slot area is connected to the opening area, in an assembled state, the circular plate is parallel to the connection post, and the circular plate passes through the slot area.

8. The satellite antenna as claimed in claim 6, wherein in the fixing state, the pivot portion is located in the opening area, and the circular plate is perpendicular to the connection post.

9. The satellite antenna as claimed in claim 6, further comprising a receiver and a connection rod, wherein the first member is a satellite dish, the second member is a supporting frame, the receiver is corresponding to the first surface of the first member, the second member is connected to the satellite dish, and the connection rod is connected to the second member and the receiver.

10. The satellite antenna as claimed in claim 9, wherein the first opening is formed in a circular recess, and the circular recess is formed on the first surface.

11. The satellite antenna as claimed in claim 9, wherein the abutting element pivots between an abutting orientation and a releasing orientation, the abutting element comprises a cam portion and a wrench portion, an extending direction of the cam portion is perpendicular to an extending direction of the wrench portion, and in the fixing state, the abutting element is in the abutting orientation, the cam portion abuts a third surface of the second member, and the first surface is opposite the third surface.

* * * * *